United States Patent [19]

Eyerle

[11] 4,341,253

[45] Jul. 27, 1982

[54] COVER ARRANGEMENT FOR SERVICING HOLES

[76] Inventor: Anton Eyerle, Stettiner Str. 14, D-8950 Kaufbeuren, Fed. Rep. of Germany

[21] Appl. No.: 126,107

[22] Filed: Feb. 29, 1980

[30] Foreign Application Priority Data

Dec. 11, 1979 [AT] Austria ..... 7217/79

[51] Int. Cl.[3] ..... E06B 9/08

[52] U.S. Cl. ..... 160/133; 160/287; 160/193

[58] Field of Search ..... 160/133, 201, 236, 218, 160/281, 25

[56] References Cited

U.S. PATENT DOCUMENTS

| | | | |
|---|---|---|---|
| 707,609 | 8/1902 | Milans | 160/287 |
| 1,100,598 | 6/1914 | McLaren et al. | 160/287 |
| 2,173,900 | 9/1939 | Dunn | 160/133 |
| 2,958,083 | 11/1960 | Shook et al. | 160/238 |
| 3,025,532 | 3/1962 | Skuda | 160/282 |
| 3,490,514 | 1/1970 | Duncan et al. | 160/133 |

FOREIGN PATENT DOCUMENTS

| | | | |
|---|---|---|---|
| 1172560 | 12/1969 | United Kingdom | 160/282 |
| 151392 | 8/1955 | Sweden | 160/201 |

*Primary Examiner*—C. J. Husar
*Assistant Examiner*—C. S. Lieberman
*Attorney, Agent, or Firm*—Alfred H. Hemingway, Jr.; Steven H. Bazerman

[57] ABSTRACT

A cover for servicing holes in automotive service stations consists of a band of pivotably connected support members, the ends of which are supported on the longitudinal hole edges. The band is displaceable longitudinally in opposite directions by at least one motor drive to open and close the servicing hole. During the opening movement the band is moved downwardly at one front end of the longitudinal hole. In order to avoid a broadening of this region of the hole the support members are telescopically assembled and are compressed to a reduced length in this region than in the covering region of the servicing hole.

4 Claims, 5 Drawing Figures

10
14
16
18
20
22
24
26
28
30
32
34
40
42
44
46
50
A
B
C

COVER ARRANGEMENT FOR SERVICING HOLES

BACKGROUND OF THE INVENTION

German Pat. No. 26 46 395 shows a cover for servicing holes in automotive service stations, comprising a band of parallel support members pivotably connected with one another and supported at their ends on horizontal guide rails arranged at the upper longitudinal edges of the hole, the band of support members being longitudinally displaceable; a driving motor for displacing the band of support members.

The support members of this known structure are necessarily longer than the width of the servicing hole. Therefore the width of the hole must be broadened at one end of the hole for the vertical run of the support members. This can be accomplished easily if new holes are built. In contrast to that the known cover arrangement cannot be used for existing holes having parallel side surfaces and therefore being of constant width over the whole length of the hole, without a remarkable rebuilding of the hole.

BRIEF DESCRIPTION OF THE INVENTION

It is one object of the invention to provide a cover arrangement which can easily be installed in servicing holes having a constant width over the whole length.

It is still another object of the invention to provide a cover arrangement which can be assembled in working holes of different widths, having parallel vertical side surfaces, the holes being provided to get access to the under side of automobiles.

It is a still further object of the invention to provide a cover arrangement in which the support members contact oppositely arranged guide surfaces facing one another and are self-adjusting with respect to the actual spacing therebetween.

One further object of this invention consists in the combination of the following features comprising vertical guide surfaces for the ends of the support members provided at opposite vertical side surfaces of the hole adjacent one front surface thereof; said vertical guide surfaces having a reduced spacing with respect to the spacing between vertical surfaces of said horizontal guide rails; and a telescopic construction of the support members.

According to one embodiment of the invention it is provided that at each end of each support member a partially protruding roller is rotatably arranged and that each support member consists of a middle portion and a pair of end portions, inserted from opposite into the middle portion and a compression spring is arranged between said end portions urging them outwardly in contact with said vertical surfaces of the guide rails or said vertical guide surfaces.

DETAILED DESCRIPTION OF THE INVENTION

Figures 1, 2:
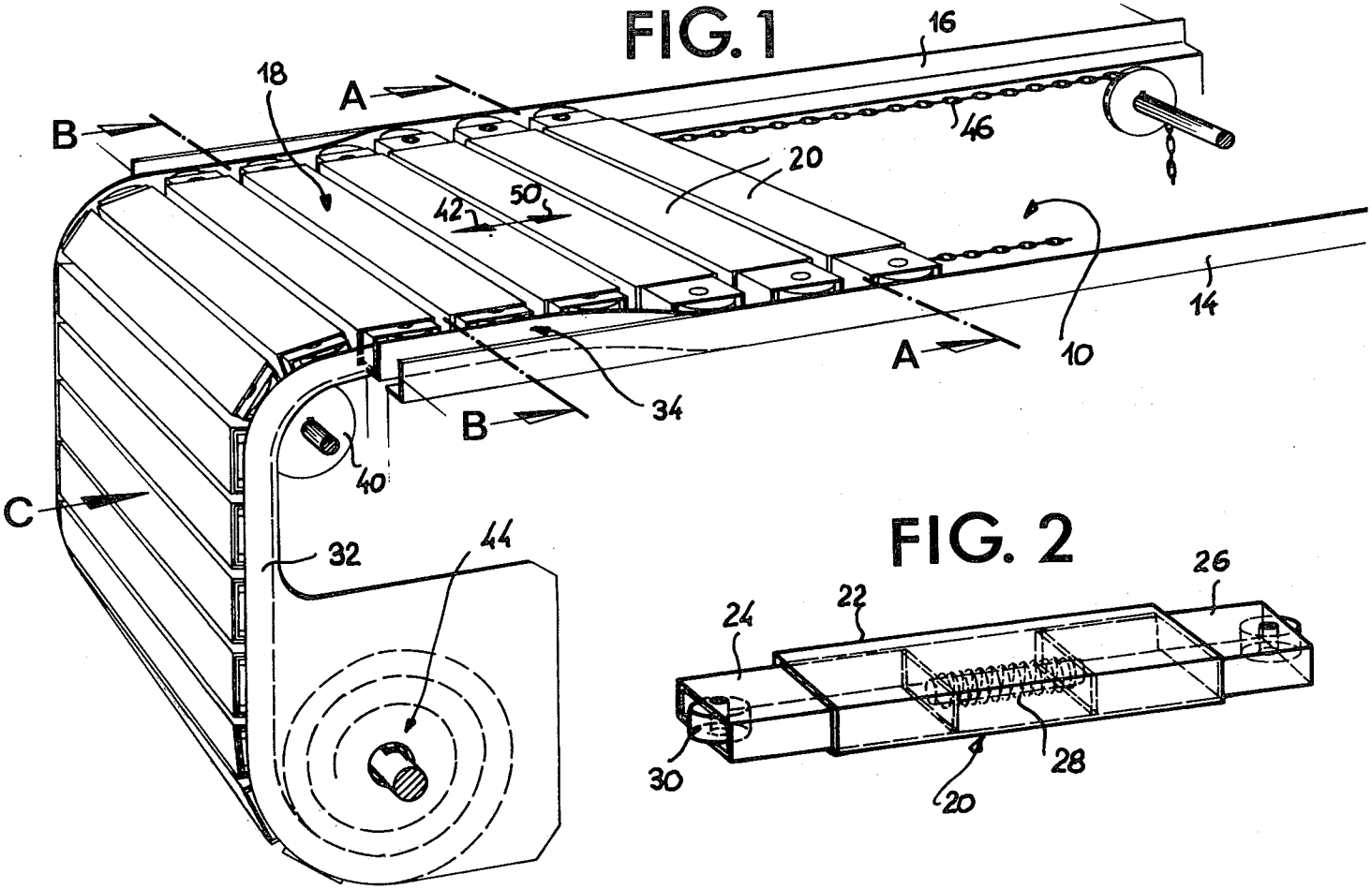
FIG. 1 is a perspective view of a cover arrangement of a servicing hole, which has been partially cutaway.
FIG. 2 is a perspective view of a telescopic arrangement of a support member used for the cover arrangement of FIG. 1.
Figure 3:
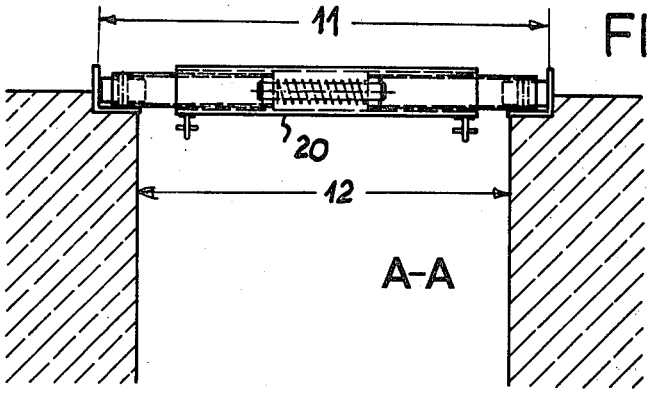
FIG. 3 is a sectional view taken along A—A of FIG. 1.
Figure 4:
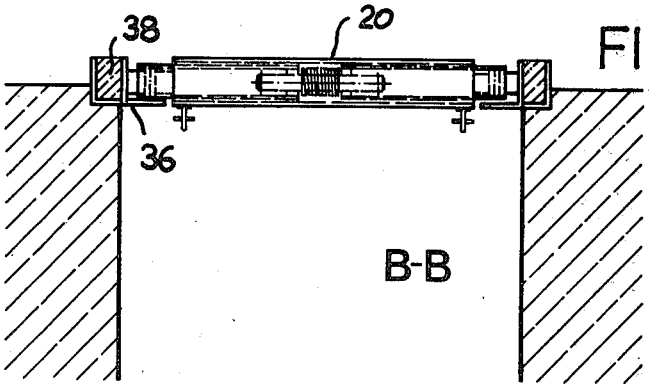
FIG. 4 is a sectional view taken along B—B of FIG. 1.
Figure 5:
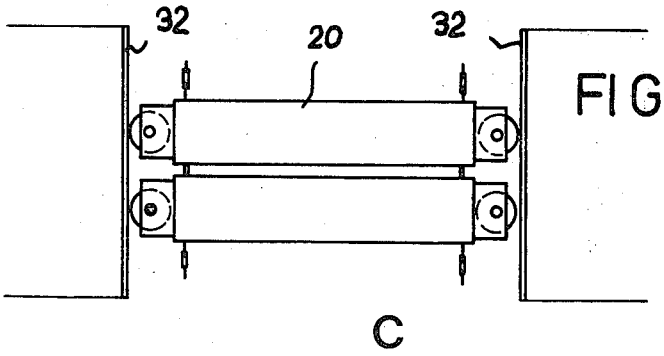
FIG. 5 is a front view in the direction of arrow C in FIG. 1.

As shown in the drawing the hole 10 is of a constant width over the whole length marked 12 in FIG. 3. At both upper longitudinal edges of the hole 10 guide rails 14, 16 of L-shape cross-section are mounted in contrast to the drawing preferably flush with the bottom of the service station. A band 18 of a plurality of pivotably connected elongate support members forms the cover arrangement for the servicing hole 10. The support members extend across the hole and are supported on the horizontal surfaces of the guide rails 14, 16. Each support member 20 is a telescoping member having a middle portion 22 of a box beam section with open ends and a pair of end portions 24, 26 inserted into the middle portion from opposite ends respectively, partly protruding therefrom. The middle portion 22 forms a guide for a reciprocating relative displacement of the end portions 24, 26. The end portions 24, 26 have abutments at their facing front sides for a compression spring 28. The end portions 24, 26 are open at their outer front sides and a roller 30 partly protruding from the outer end of each end portion 24, 26 is rotatably supported on an axis fastened between an upper and a lower wall of the end portion, so that the roller rotates about a vertical axis when the support members 20 are moved horizontally along the guide rails 14, 16.

Vertical guide surfaces in form of thin planar plates 32 are arranged adjacent the side surfaces of the hole 10 at the rearward end of which. The space 12 between the guide surfaces 32 for the band of support members is less with respect to the greater spacing 11 between the vertical flanges of the guide rails 14, 16 so that the support members 20 are telescopically extended when they are positioned on the horizontal guide rails 14, 16 and their rollers 30 contact the vertical flanges thereof. But when the support members 20 are positioned between the pair of vertical guide surfaces 32 they are telescopically compressed.

Connection ramps 36 are provided between each horizontal guide rail 14 or 16 and the vertical guide surface 32 respectively. The connection ramp 36 consists of a bent, curved or linear inclined L-bar spaced from the guide rail 14 or 16 by an insert 38. The vertical flange of the L-bar provides a continuous transition between the guide rail 14 or 16 and the guide surface 32. At the end of the ramp 36 a support roller 40 is rotatably arranged in the pair of plates forming the vertical guide surfaces 32. The circumference of support roller 40 is substantially flush with the horizontal flanges of the L-bars. When therefore the cover band 18 is moved in the opening direction 42 the support members 20 slide along the pair of guide rails 14, 16, then when they move into the region of the ramps 37 are gradually compressed to a length substantially corresponding to the distance 12 so that they fit between the vertical guide surfaces 32. The support members leave the ramps 36, move about the roller 40 and are deflected in vertical direction. Then they slide downwards in their telescopically compressed state whereby the ends of which contact the vertical guide surfaces 32 and then are wound on a winding drum 44 rotatably supported between flanges of the plates forming the vertical guide surfaces 32. The winding drum is situated below the roller 40 and above the floor of the hole 10 and is drivingly connected with an electric motor. The other end of the cover band 18 is connected via chains 46 and pulleys 48 with a second drive mechanism (not shown) provided at the opposite end of the hole 10, in order to unwind the band from the drum 44 and move the band forwards in the direction indicated by arrow 50 to close the hole.

According to a different construction instead of providing two separate drives both ends of the cover band 18 can be connected by chains to form an endless arrangement running about a plurality of pulleys. This endless arrangement can be driven by a single reversible motor.

What I claim is:

1. An arrangement for covering and uncovering a hole provided in the floor of automotive service stations, the hole having a rectangular horizontal cross-section and vertical side surfaces, said arrangement comprising: a pair of guide rails extending along the upper edges of the side surfaces of the hole, said guide rails each having a horizontal flange and a vertical flange, the horizontal flanges of said pair of guide rails being supported on the floor and the oppositely arranged vertical flanges having a spacing larger than the width of the hole, a pair of vertical guide plates being arranged within the hole of one front end and adjacent the side walls thereof, the spacing of the vertical guide plates being smaller than that between the horizontal flanges of said pair of guide rails, a pair of connection ramps, each of said ramps providing a continuous transition between the vertical flanges of one of the guide rails and the vertical guide plate, a plurality of parallel elongated support members pivotably connected with one another forming said cover for the hole, the ends of said support members being supported on the horizontal flanges of the guide rails, each one of said plurality of support members being of a telescopic construction, a compression spring arranged within each one of said plurality of support members, said compression spring urging the ends of each support member in contact with said vertical flanges of the guide rails, and a driving device for moving the plurality of support members from a first position between the pair of guide rails into a second position between the pair of guide plates, whereby the support members one after another becoming telescopically compressed when passing said pair of ramps.

2. An arrangement as claimed in claim 1, wherein: each end at each support member is provided with a rotatably mounted roller, the rotating axis of which extends vertically when the support member takes its first position between said pair of horizontal guide rails.

3. An arrangement as claimed in claim 1, wherein: each support member is defined by a hollow open ended middle portion and a pair of displaceable end portions, between which the compression spring is inserted.

4. An arrangement as claimed in claim 1, wherein: a winding drum is rotatably supported by said pair of guide plates.

* * * * *